US005973650A

United States Patent [19]

Nakanishi

[11] Patent Number: 5,973,650

[45] Date of Patent: Oct. 26, 1999

[54] ANTENNA APPARATUS

[75] Inventor: Hideo Nakanishi, Yokohama, Japan

[73] Assignee: Matsushita Electric Industrial Co., Ltd., Japan

[21] Appl. No.: 08/962,656

[22] Filed: Nov. 3, 1997

[30] Foreign Application Priority Data

Nov. 22, 1996 [JP] Japan ..... 8-311990

[51] Int. Cl.[6] ..... H01Q 11/14

[52] U.S. Cl. ..... 343/742; 343/744

[58] Field of Search ..... 343/748, 741, 343/742, 743, 744, 702, 867; H01Q 7/00, 11/12, 11/14

[56] References Cited

U.S. PATENT DOCUMENTS 4,947,180 8/1990 Schotz ..... 343/744

*Primary Examiner*—Michael C. Wimer

*Attorney, Agent, or Firm*—Parkhurst & Wendel, L.L.P.

[57] ABSTRACT

An antenna apparatus is disclosed which comprises: a printed circuit board; a first loop antenna, arranged along one side of the printed circuit board, wound more than one turn; a second loop antenna, arranged along the side, wound less than one turn, one end of the first loop antenna and one end of the second loop antenna being fixed to a first area on the printed circuit board near the side; and a capacitor, fixed to a second area of the printed circuit board remote from the first area near the side, having one end connected to another end of the first loop antenna and another end connected to another end of the second loop antenna. In the antenna apparatus, the first and second loop antennas may comprise conductive rods. In the antenna apparatus, the first and second loop antennas may comprise stripe conductive plates. In the antenna apparatus, the first area and second area are remote with a distance from 5 mm to 15 mm, or a distance more than 15 mm to 30 mm, favorably, or a distance more than 30, most favorably.

8 Claims, 6 Drawing Sheets

ANTENNA APPARATUS

BACKGROUND OF THE INVENTION

1. Field of the Invention

This invention relates to an antenna apparatus.

2. Description of the Prior Art

A loop antenna is used for the VHF and UHF bands because its structure is simple and a loss is relatively little when it is held near a human body.

A double loop antenna is also known of which gain is improved.

FIG. 10 is a schematic drawing of a prior art double loop antenna. The prior art double loop antenna comprises a first loop antenna 121, a first feeding point 125 for connecting the first loop antenna 121 to a receiving circuit 123 through an input capacitor 124 on a printed circuit board 122, a capacitor 126 coupled to the first loop antenna 121 in series, a second loop antenna 127 connected to the capacitor 126, a second feeding point 128 located on the side of the first feeding point 125 for connecting the second loop antenna 127 to the ground common to the receiving circuit123, and a variable capacitor 129.

SUMMARY OF THE INVENTION

The aim of the present invention is to provide an improved antenna apparatus.

According to the present invention, an antenna apparatus is provided, which comprises: a printed circuit board; a first loop antenna, arranged along one side of the printed circuit board, wound more than one turn; a second loop antenna, arranged along the side, wound less than one turn, one end of the first loop antenna and one end of the second loop antenna being fixed to a first area on the printed circuit board near the side; and a capacitor, fixed to a second area of the printed circuit board remote from the first area near the side, having one end connected to another end of the first loop antenna and another end connected to another end of the second loop antenna.

In the antenna apparatus, the first and second loop antennas may comprise conductive rods.

In the antenna apparatus, the first and second loop antennas may comprise stripe conductive plates.

In the antenna apparatus, the first area and second area are remote with a distance from 5 mm to 15 mm, or a distance more than 15 mm to 30 mm, favorably, or a distance more than 30 mm, most favorably.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

Hereinbelow will be described a first embodiment of this invention.

Figure 1:
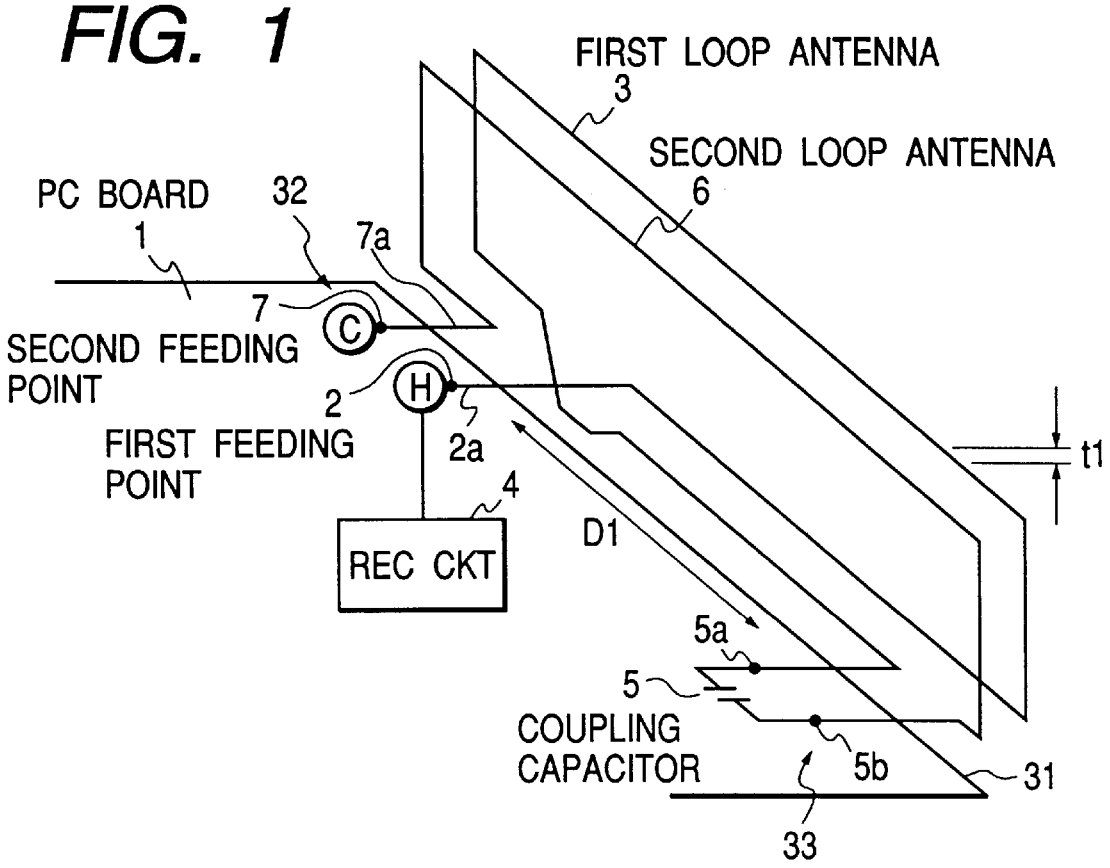
FIG. 1 is a schematic diagram of an antenna apparatus of a first embodiment.

FIG. 1 is a schematic diagram of an antenna apparatus of the first embodiment. The antenna apparatus of the first embodiment comprises a printed circuit board 1, a first loop antenna 3, arranged along one side 31 of the printed circuit board 1, wound more than one turn, a second loop antenna 6, arranged along the side 31, wound less than one turn, one end 2 (first feeding point) of the first loop antenna 3 and one end 7 (second feeding point) of the second loop antenna 6 being fixed to a first area 32 on the printed circuit board 1 near the side 31, and a capacitor 5, fixed to a second area 33 of the printed circuit board 1 remote from the first area 32 near the side 31, having one end 5*a* connected to another end of the first loop antenna 3 and another end 5*b* connected to another end of the second loop antenna 6. The first feeding point 2 is connected to a hot side (H) feeding output of a receiving circuit 4 and the second feeding point 7 is connected to a cold side (C) feeding output of the receiving circuit 4. The first and second loop antennas 3 and 6 are formed in rectangular shapes substantially and the longitudinal direction of the rectangular shapes is in parallel to the side 31.

The first and second loop antennas 3 and 6 comprise conductive rods.

Figure 2:
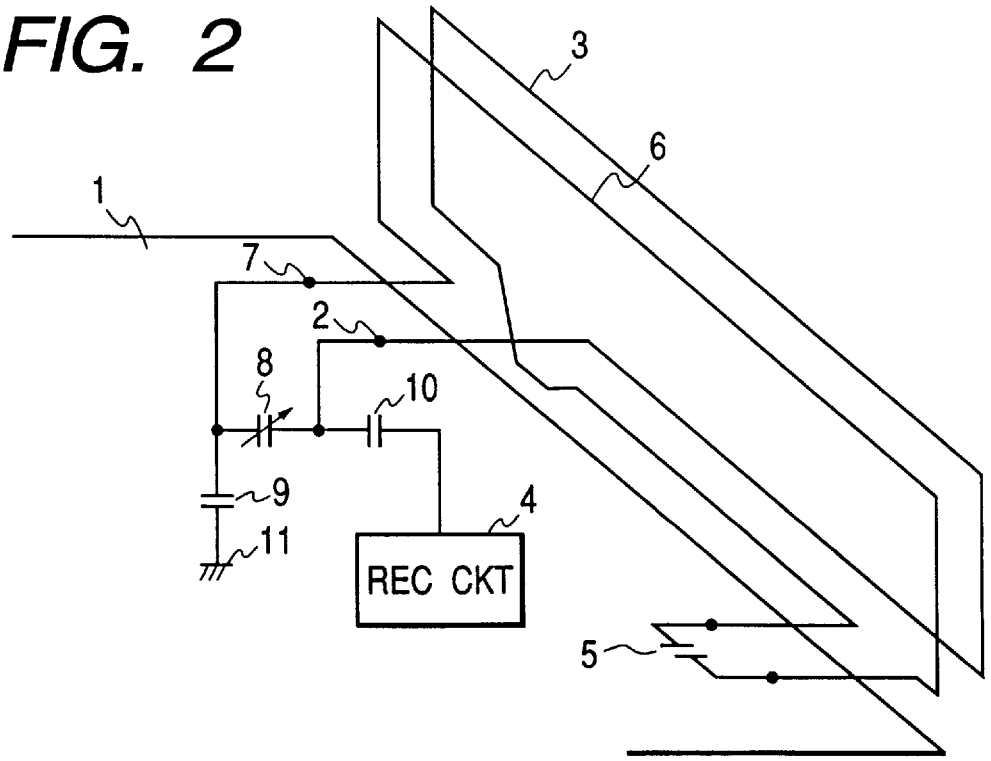
FIG. 2 is a schematic diagram of the first embodiment showing interconnection of the antenna apparatus shown in FIG. 1.

FIG. 2 is a schematic diagram showing interconnection of the antenna apparatus of the first embodiment.

The antenna apparatus of the first embodiment operates as a magnetic field loop antenna and feeds a received signal to the receiving circuit 4. The first feeding point 2 is connected to the hot side feeding output of the receiving circuit 4 through an input capacitor 10. The second feeding point 7 is connected to the ground through a capacitor 9. A variable capacitor 8 is connected between the first and second feeding points 2 and 7 provided for tuning.

The coupling capacitor 5 is provided to optimize the variable frequency range by the variable capacitor 8 and it is not necessary to locate the coupling capacitor 5 adjacent to the first and second feeding points 2 and 7, so that the coupling capacitor 5 is located at the second area 33 remote from the first area 32 to which the first and second feeding points 2 and 7 are fixed. That is, the coupling capacitor 5 is fixed to the second area with a distance D1 from the first area 32, so that the antenna gain is improved.

More specifically, this arrangement reduces a loss in the received signal because if the coupling capacitor 5 is located near the first area 32, the loss between the coupling capacitor 5 and the feeding patterns 2*a* and 7*a*would occur.

Figure 3A:
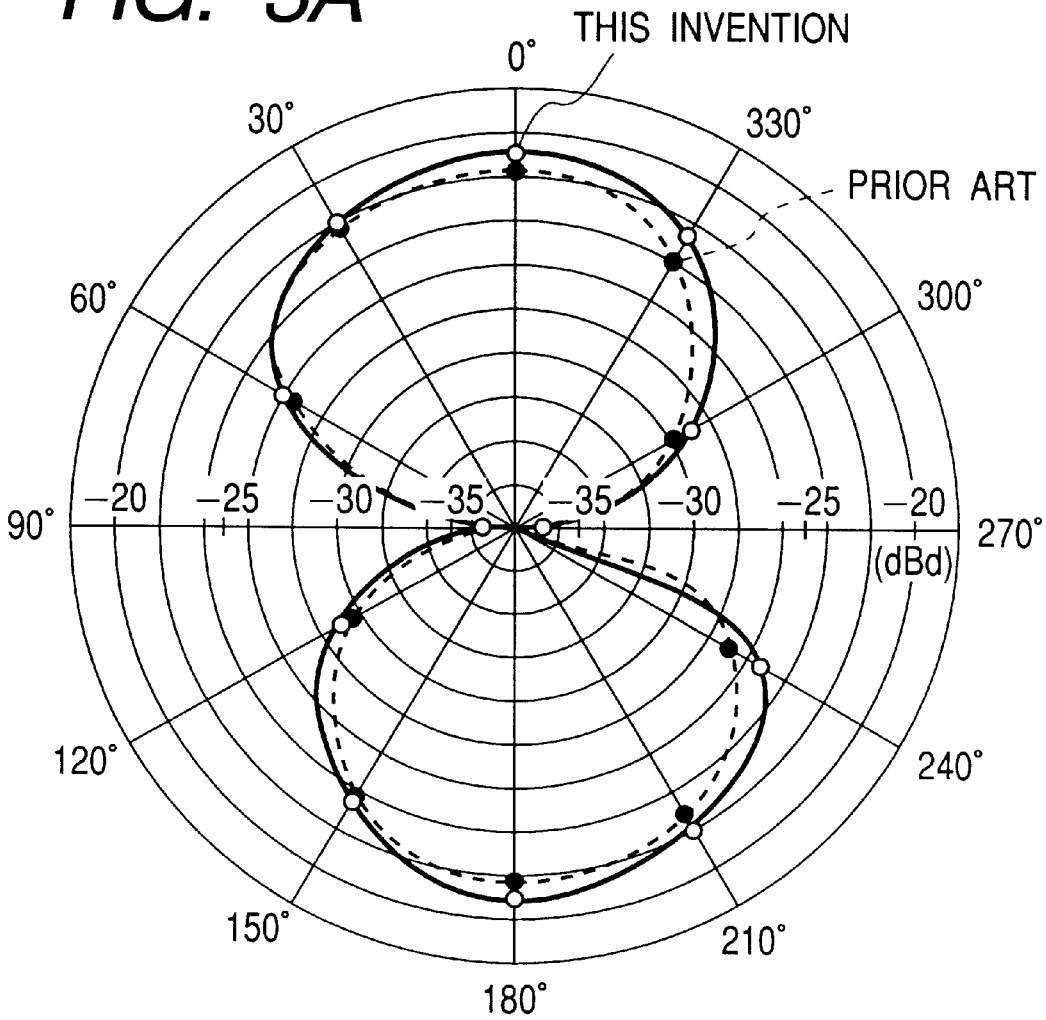
FIG. 3A is a graphical drawing showing a directional characteristic of this invention.
Figure 3B:
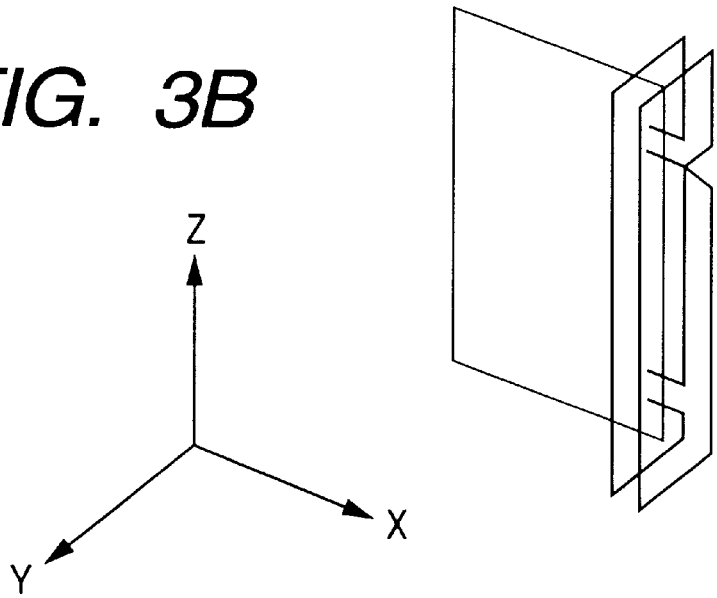
FIG. 3B is an illustration of the first embodiment showing a measuring condition.
Figure 10:
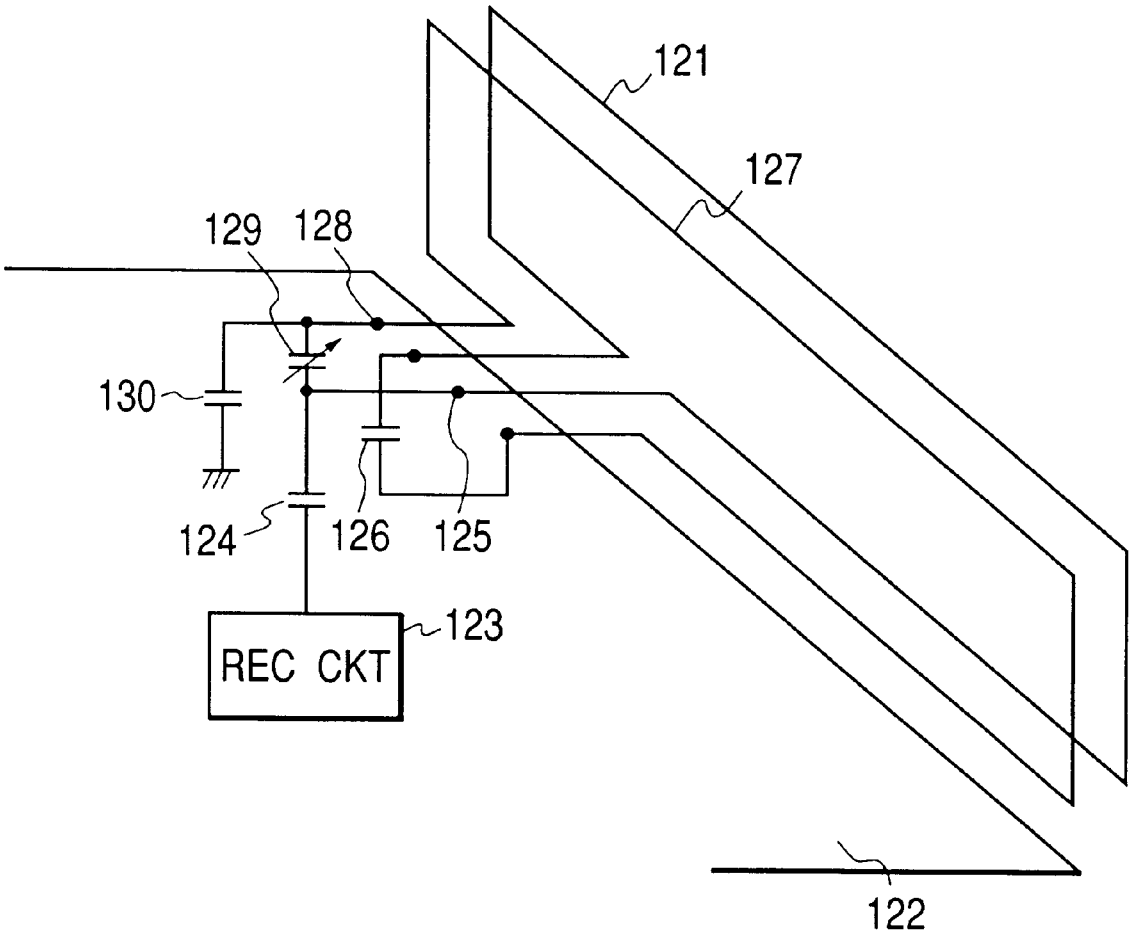
FIG. 10 PRIOR ART
FIG. 10 is a schematic drawing of a prior art double loop antenna.

FIG. 3A is a graphical drawing showing a directional characteristic of this invention and that of the prior art shown in FIG. 10 for comparing. FIG. 3B is an illustration of the first embodiment showing a measuring condition.

In the directional characteristic of the antenna apparatus of the first embodiment, antenna gains are improved, for example, the antenna gains at 0° and 180° are improved by about 0.7 dB.

As mentioned, the coupling capacitor 5 is located remote from the first and second feeding points 2 and 7, so that the antenna gain is improved over all directions.

Figure 4:
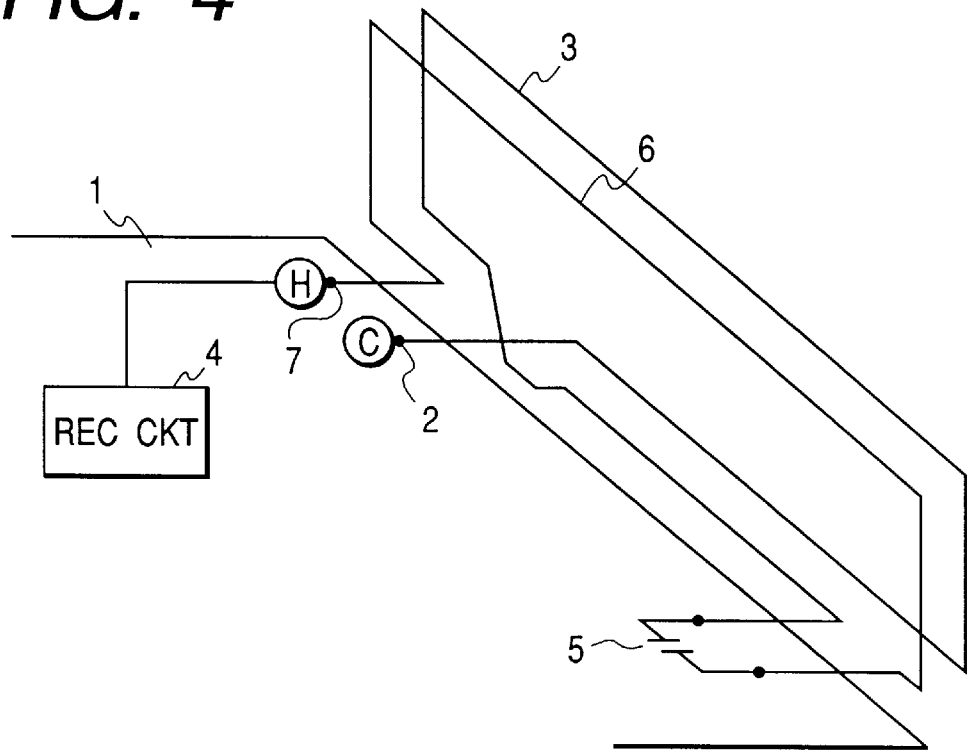
FIG. 4 is a schematic diagram of the antenna apparatus of the first embodiment showing another operation condition.
Figure 5:
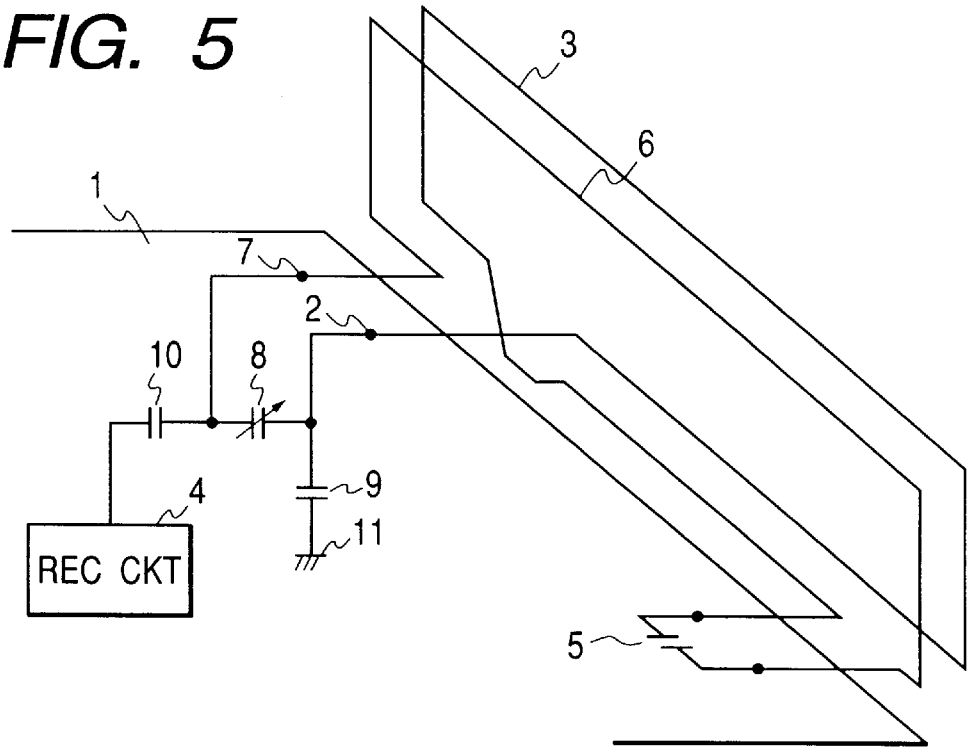
FIG. 5 is a schematic diagram of the first embodiment showing interconnection of the antenna apparatus used in another operation condition shown in FIG. 4.

FIG. 4 is a schematic diagram of the antenna apparatus of the first embodiment showing another operation condition. That is, the receiving circuit 4 is connected to the antenna apparatus in the opposite polarity, that is, the hot side feedng output of the receiving circuit 4 is connected to the second feeding point 7 and the cold side feeding output of the receiving circuit 4 is connected to the first feeding point 2. FIG. 5 is a schematic diagram showing interconnection of the antenna apparatus used in the operation condition shown in FIG. 4.

The structure and the operation shown in FIGS. 4 and 5 are similar to those shown in FIG. 1 and 2.

A second embodiment will be described.

Figure 6:
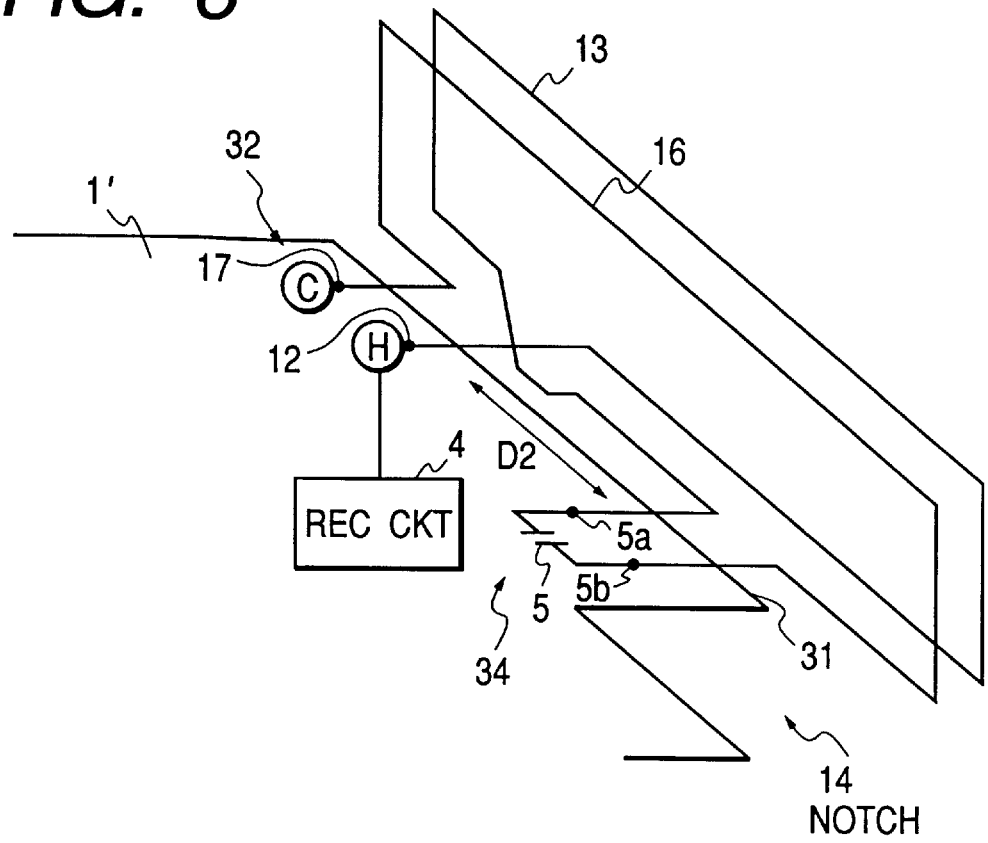
FIG. 6 is a schematic diagram of an antenna apparatus of a second embodiment.

FIG. 6 is a schematic diagram of an antenna apparatus of the second embodiment. The antenna apparatus of the second embodiment comprises a printed circuit board 1' having a notch 14, a loop antenna 13, arranged along one side 35 of the printed circuit board 1', wound about 1+¼ turn, a loop antenna 16, arranged along the side 35, wound about ¾ turn, one end 12 (feeding point) of the first loop antenna 13 and one end 17 (feeding point) of the loop antenna 16 being fixed to the first area 32 on the printed circuit board 1' near the side 35, and the capacitor 5, fixed to a third area 34 of the printed circuit board 1' remote from the first area 32 near the side 31, having one end 5*a* connected to another end of the loop antenna 13 and another end 5*b* connected to another end of the loop antenna 16. The feeding point 12 is connected to the hot side (H) feeding output of the receiving circuit 4 and the feeding point 17 is connected to the cold side (C) feeding output of the receiving circuit 4. The loop antennas 13 and 16 are formed in rectangular shapes substantially and the longitudinal direction of the rectangular shapes is in parallel to the side 35. However, the notch 14 is provided at the second area 33 described in the first embodiment. Therefore, the coupling capacitor 5 is fixed to an area 34 with a distance D2 from the feeding point 12, which is slightly shorter than D1 of the first embodiment.

The loop antennas 13 and 16 comprise conductive rods.

Figure 7:
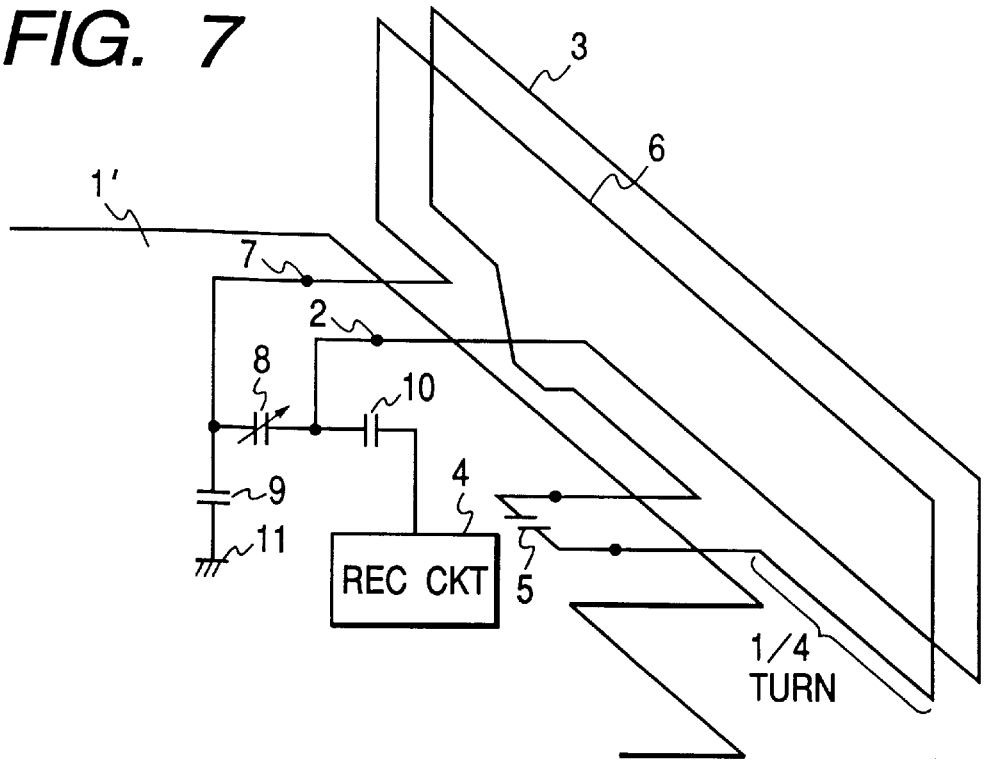
FIG. 7 is a schematic diagram of the second embodiment showing interconnection of the antenna apparatus shown in FIG. 6.

FIG. 7 is a schematic diagram showing interconnection of the antenna apparatus of the second embodiment.

The antenna apparatus of the second embodiment operates as similar to the first embodiment. The difference is that the isolation between the coupling capacitor 5 and the feeding points 12 and 17 is slightly less than that of the first embodiment but it is sufficient.

The isolation between the coupling capacitor 5 and the feeding points 12 and 17 is sufficient but is slightly affected when the distance D2 is from 5 mm to 15 mm. The isolation between the coupling capacitor 5 and the feeding points 12 and 17 is favorable but there is a slight affection between the coupling capacitor 5 and the feeding points 12 and 17 when the distance D2 is more than 15 mm to 30 mm. The isolation between the coupling capacitor 5 and the feeding points 12 and 17 is most favorable and there is little affection between the coupling capacitor 5 and the feeding points 12 and 17 when the distance D2 is more than 30 mm.

According to the second embodiment, the coupling capacitor 5 can be located sightly near the feeding points 12 and 17 than the first embodiment, so that a degree of freedom of designing the receiving apparatus including the antenna apparatus of the second embodiment is improved.

A third embodiment will be described.

Figure 8:
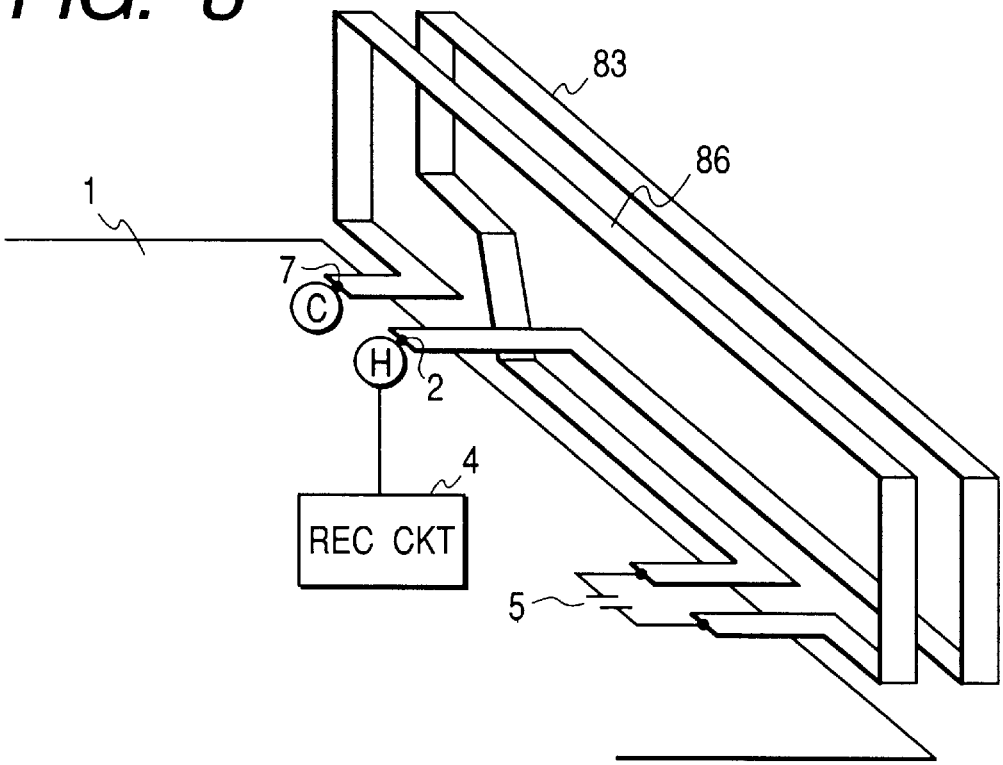
FIG. 8 is a schematic diagram of an antenna apparatus of a third embodiment.
Figure 9:
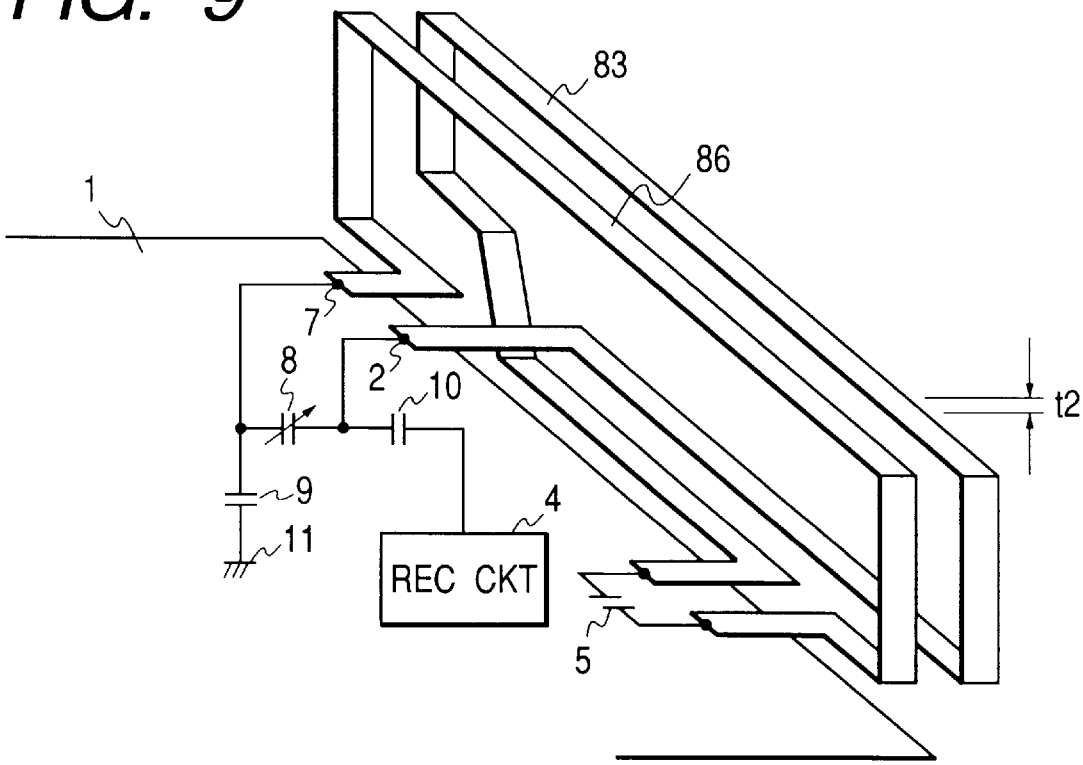
FIG. 9 is a schematic diagram of the antenna apparatus of the third embodiment showing interconnection of the antenna apparatus shown in FIG. 8.

FIG. 8 is a schematic diagram of an antenna apparatus of the third embodiment. The antenna apparatus of the third embodiment is substantially the same as the first embodiment. The difference is that the loop antennas 83 and 86 comprise stripe conductive plates as shown in FIG. 8. FIG. 9 is a schematic diagram of the antenna apparatus of the third embodiment. The operation of the antenna apparatus of the third embodiment is substantially the same as the first embodiment. The difference is that the thickness t2 is less than the thickness t1 of the first embodiment.

What is claimed is:

1. An antenna apparatus comprising:

a printed circuit board;

a first loop antenna arranged along a side of said printed circuit board, said first loon antenna being wound more than one turn;

a second loop antenna arranged along said side, said second loop antenna being wound less than one turn, a first end of said first loop antenna and a first end of said second loop antenna each being fixed to a first area at a feeding point on said printed circuit board that is proximal to said side; and a capacitor being fixed to a second area of said printed circuit board adjacent to said side and distal from the first area of said printed circuit board where said first end of each of said first loop antenna and said second loop antenna are attached, said capacitor having one end connected to a second end of said first loop antenna and another end connected to a second end of said second loop antenna.

2. The antenna apparatus according to claim 1, wherein said first and second loop antennas further comprise conductive rods.

3. The antenna apparatus according to claim 1, wherein said first and second loop antennas further comprise stripe conductive plates.

4. The antenna apparatus according to claim 1, wherein the first area and the second area are spaced apart from each other by a distance ranging from about 5 mm to 15 mm.

5. The antenna apparatus according to claim 1, wherein the first area and the second area are spaced apart from each other by a distance ranging from about more than 15 mm to 30 mm.

6. The antenna apparatus according to claim 1, wherein the first area and the second area are spaced apart from each other by a distance of more than 30 mm.

7. An antenna apparatus according to claim 1 wherein said capacitor is electrically connected in series between the second end of said first loop antenna and the second end of said second loop antenna so that said capacitor is positioned at an intermediate point between said first loop antenna and said second loop antenna; and each first end of said first loop antenna and said second loop antenna is electrically connected at a respective feeding point.

8. An antenna apparatus according to claim 1 wherein said first loop antenna and said second loop antenna are located outside of a perimeter of said printed circuit board.

* * * * *